US008122916B2

(12) United States Patent
Nagaoka et al.

(10) Patent No.: US 8,122,916 B2
(45) Date of Patent: Feb. 28, 2012

(54) REINFORCING BAR BINDING MACHINE, WIRE REEL, WIRE, AND METHOD OF DETERMINING KIND OF WIRE

(75) Inventors: Takahiro Nagaoka, Tokyo (JP); Ichiro Kusakari, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 12/903,705

(22) Filed: Oct. 13, 2010

(65) Prior Publication Data

US 2011/0030836 A1 Feb. 10, 2011

Related U.S. Application Data

(62) Division of application No. 11/579,376, filed as application No. PCT/JP2005/008039 on Apr. 27, 2005.

(30) Foreign Application Priority Data

May 7, 2004 (JP) ..... P 2004-139069

(51) Int. Cl.
*B21F 9/02* (2006.01)

(52) U.S. Cl. ..... 140/93.2

(58) Field of Classification Search ..... 140/57, 140/93.2, 93.6, 93 A, 118, 119, 149; 242/563, 242/588.6, 600, 614, 912
See application file for complete search history.

(56) References Cited

U.S. PATENT DOCUMENTS 4,516,713 A * 5/1985 Meijer ..... 242/563.2
4,756,488 A 7/1988 Cooke
5,279,336 A 1/1994 Kusakari et al.
5,515,887 A 5/1996 Hanagasaki et al.
5,657,799 A 8/1997 Kusakari et al.
5,678,613 A 10/1997 Murayama et al.
5,831,404 A 11/1998 Ishii
5,871,036 A 2/1999 Murayama et al.
5,874,816 A 2/1999 Ishii
5,897,075 A 4/1999 Elder et al.
6,125,338 A 9/2000 Brienza et al.
7,204,276 B2 4/2007 Nakagawa et al.

(Continued)

FOREIGN PATENT DOCUMENTS

DE 44 13 627 B4 10/1994

(Continued)

OTHER PUBLICATIONS

Machine Translation of JP 3050369 B, 4 pages.*

(Continued)

*Primary Examiner* — Teresa Ekiert

(74) *Attorney, Agent, or Firm* — Morgan, Lewis & Bockius LLP

(57) ABSTRACT

A wire reel containing portion 3 of a reinforcing bar binding machine 1 is provided with a rotation detecting lever 8 and a photosensor 7. When a wire reel is rotated in starting to bind a wire, rotation thereof is detected by the rotation detecting lever switched ON/OFF by a projected portion formed at a side face of the wire reel, the photosensor detects a reflection mark of the wire reel to determine a kind of the wire from a number of the marks, and a twist torque or the like is controlled. Wire information is detected not in an initializing operation (in setting wire) of rotating the wire reel at low speed but in a binding operation of rotating at high speed and therefore, an amount of swinging the rotation detecting lever is large and wire information can firmly be detected.

14 Claims, 11 Drawing Sheets

U.S. PATENT DOCUMENTS

| | | | |
|---|---|---|---|
| 7,353,846 | B2 | 4/2008 | Kusakari et al. |
| 7,398,800 | B2 | 7/2008 | Kusakari et al. |
| 2005/0061389 | A1 | 3/2005 | Nakagawa et al. |
| 2005/0087646 | A1 | 4/2005 | Nakagawa et al. |
| 2006/0283516 | A1 | 12/2006 | Nagaoka et al. |
| 2007/0199610 | A1 | 8/2007 | Itagaki |
| 2007/0227613 | A1 | 10/2007 | Matsuoka et al. |
| 2008/0006341 | A1 | 1/2008 | Kusakari et al. |

FOREIGN PATENT DOCUMENTS

| | | | |
|---|---|---|---|
| EP | 0 751 270 | A1 | 1/1997 |
| JP | 8-114034 | | 5/1996 |
| JP | 8-114035 | | 5/1996 |
| JP | 9-165918 | | 6/1997 |
| JP | 2557192 | Y | 8/1997 |
| JP | 10-150890 | | 6/1998 |
| JP | 3-050369 | B | 3/2000 |
| JP | 2003-175905 | | 6/2003 |

OTHER PUBLICATIONS

Machine Translation of JP 2557192 Y2.

* cited by examiner

REINFORCING BAR BINDING MACHINE, WIRE REEL, WIRE, AND METHOD OF DETERMINING KIND OF WIRE

This is a divisional application of copending Application No. 11/579,376, filed on Nov. 2, 2006, which depends from international application PCT/JP2005/08039 dated Apr. 27, 2005 and are hereby incorporated by reference.

TECHNICAL FIELD

The present invention relates to a reinforcing bar binding machine, particularly relates to a reinforcing bar binding machine for controlling a torque of twisting or an amount of feeding a binding wire based on a kind of the binding wire.

BACKGROUND ART

JP-A-08-114034 and JP-A-08-114035 disclose a motor drive type reinforcing bar binding machine provided with: a binding wire feeding mechanism for feeding a binding wire (wire) while bending the wire in a loop-like shape to hang around a reinforcing bar; and a binding wire twisting mechanism for twisting to bind a binding wire wound around the reinforcing bar, and carrying out 1 cycle of binding operation by continuously executing a binding wire feeding operation and a binding wire twisting operation by an operation of a trigger.

Further, Japanese patent No. 3050369 discloses a reinforcing bar binding machine in which a wire reel is provided with indication means indicating a kind of a wire, the reinforcing bar binding machine is provided with means for detecting the wire kind indication means of the wire reel, and means for controlling a torque of twisting a wire in accordance with a kind of the wire, the kind of the wire is detected by the detecting means, and the wire twisting torque is automatically set to a suitable value in accordance with the kind of the wire by the control means.

In the reinforcing bar binding machine, the determination of the kind of the wire is carried out as one element of initializing operation of the reinforcing bar binding machine, when the wire reel is charged to the reinforcing bar binding machine and power source is applied, the control portion feeds the wire by a certain predetermined length by driving a biding wire feeding mechanism at a low speed, and a front end of the wire passes a binding wire cutting mechanism arranged at a vicinity of a nose. During rotating the wire reel at the low speed, wire information indication portion provided at the wire reel is detected by detecting means of the reinforcing bar binding machine.

Although it is general that the wire reel used in the reinforcing bar binding machine is formed by a plastic material in view of formability and cost. However, in the wire reel made of plastic, a wire binding state is changed and a dimension of a bearing hole of the wire reel is varied, by outer air temperature or the like.

Therefore, when dimensions of a reel holding shaft of the reinforcing bar binding machine and the bearing hole of the wire reel are made to be substantially the same, there is a concern that the wire reel cannot be freely be rotated and therefore, the bearing hole of the wire reel is made to be slightly larger than a diameter of the reel holding shaft portion. Therefore, when the wire is drawn out at low speed and the wire reel is rotated at low speed at initializing operation of the reinforcing bar binding machine, there is a case in which the wire reel is fluctuated transversely and a center shaft of the wire reel is displaced from a center of rotation to be rotated by so-to-speak swinging rotation, so that the wire kind information provided at the wire reel cannot be read.

DISCLOSURE OF THE INVENTION

Hence, it is an object of one or more embodiments of the invention to stabilize a function of determining a wire by enabling to firmly detect a wire kind information portion provided at a flange side face of a wire reel.

According to one or more the embodiments of the invention, a reinforcing bar binding machine including a binding wire feeding mechanism, a binding wire twisting mechanism and a binding wire cutting mechanism is provided with: means for detecting wire identifying information provided at a side face of a reel flange of a wire reel in rotating the wire reel, and means for controlling a torque of twisting and an amount of feeding a wire based on the detected wire identifying information. The wire identifying information is detected from the wire reel rotated in binding wire feeding step in a binding operation and the torque of twisting and the amount of feeding the wire and the like are controlled based on the detected wire identifying information.

According to one or more the embodiments of the invention, the wire identification information detecting means is a movable member of a lever or a button type actuator opposed to a side face of the reel flange of the wire reel, a breaker switched ON/OFF by the movable member, or a switch of a Hall element or the like switched ON/OFF by a magnet provided at the movable member. When the wire reel is rotated in the binding wire feeding step in a binding operation, by displacing the movable member by a projected portion or a recess portion formed at the side face of the reel flange for indicating the wire identifying information, the wire identifying information is detected by way of the switch.

According to one or more embodiments of the invention, the wire identifying information detecting means is a photosensor opposed to the side face of the reel flange of the wire reel, when the wire reel is rotated in the binding wire feeding step in a binding operation, a reflection mark or a bar code indicating the wire identifying information formed at the side face of the reel flange is detected by way of the photosensor.

According to one or more embodiments of the invention, a reinforcing bar binding machine is provided with a wire identification information detecting mechanism for detecting wire identifying information provided at the side face of the reel flange of the wire reel in rotating the wire reel. The torque of twisting and the amount of feeding the wire are controlled based on the detected wire identifying information.

According to one or more embodiments of the invention, the reinforcing bar binding machine is provided with a binding wire feeding mechanism and a binding wire twisting mechanism and a binding wire cutting mechanism.

According to one or more embodiments of the invention, the wire identification information detecting mechanism includes a movable member opposed to the side face of the reel flange of the wire reel and a switch switched ON/OFF by the movable member.

According to one or more embodiments of the invention, the movable member includes a lever.

According to one or more embodiments of the invention, the movable member includes a button type actuator.

According to one or more embodiments of the invention, the switch includes a breaker.

According to one or more embodiments of the invention, the switch includes a Hall element.

According to one or more embodiments of the invention, the movable member includes a magnet, and the Hall element is switched ON/OFF by the magnet.

According to one or more embodiments of the invention, when the wire reel is rotated in the binding wire feeding step in the binding operation, by displacing by the movable member by the projected portion or the recess portion indicating the wire identifying information formed at the side face of the reel flange, the wire identifying information is detected by way of the switch.

According to one or more embodiments of the invention, the wire identification information detecting mechanism includes a photosensor opposed to the side face of the reel flange of the wire reel.

According to one or more embodiments of the invention, the photosensor detects the wire identifying information formed at the side face of the reel flange when the wire reel is rotated in the binding wire feeding step in the binding operation.

According to one or more embodiments of the invention, the wire identifying information includes the reflection mark.

According to one or more embodiments of the invention, the wire identifying information includes a bar code.

According to one or more embodiments of the invention, the wire identification information detecting mechanism includes a movable member opposed to the side face of the reel flange of the wire reel, a switch switched ON/OFF by the movable member, and a photosensor opposed to the side face of the reel flange of the wire reel.

According to one or more embodiments of the invention, the wire reel includes a hub in a cylindrical shape, a pair of reel flanges provided at both side faces of the hub, a projected portion provided at an outer side face of one of the reel flanges, and a refection mark provided at the outer side face.

According to one or more embodiments of the invention, the projected portion includes a rib in which a shape of a side face thereof extended radially from a position of an outer periphery of the hub is a triangular shape, and the reflection mark includes a pin made of a resin of white color.

According to one or more embodiments of the invention, two of the projected portions are provided at 180 degrees rotationally symmetrical positions.

According to one or more embodiments of the invention, the wire is wound around a wire reel including a hub in a cylindrical shape, a pair of reel flanges provided at both side faces of the hub, a projected portion provided at an outer side face of one of the reel flange and a reflection mark provided on the outer side face.

According to one or more embodiments of the invention, when the wire reel is rotated and the detecting signal is inputted from the rotation detecting lever, the reflection mark of the wire reel is started to be counted, when the detecting signal is inputted again from the rotation detecting lever, counting of the reflection mark of the wire reel is stopped, and a kind of the wire wound around the wire reel is determined from a number of the counted reflection marks.

According to one or more embodiments of the invention, the reflection mark is counted in the reinforcing bar binding operation.

According to one or more embodiments of the invention, when the number of the counted reflection marks is zero, an operation of the reinforcing bar binding machine is stopped.

Other aspects and advantages of the invention will be apparent from the following description of embodiments and the appended claims.

DESCRIPTION OF THE REFERENCE NUMERALS AND SIGNS

Figure 1:
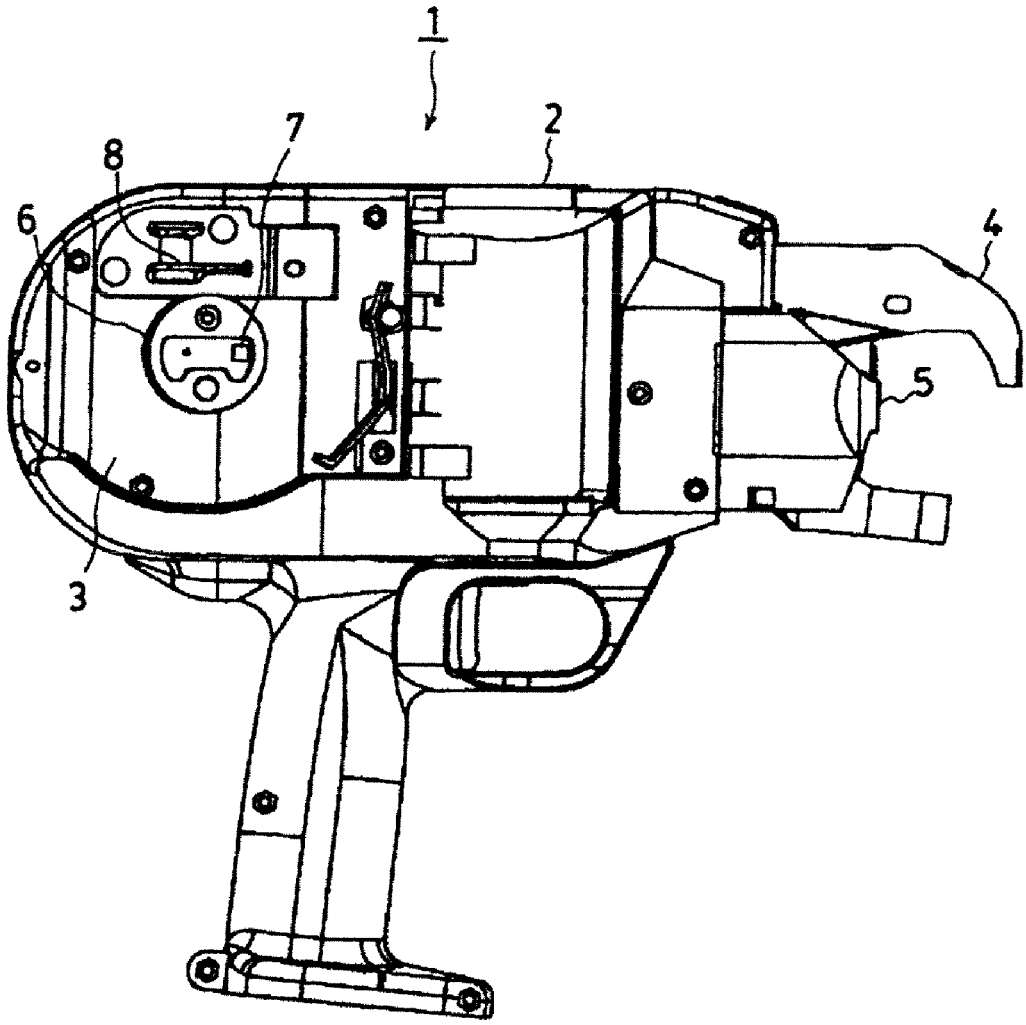
FIG. 1 is a right side view of a reinforcing bar binding machine.

1 . . . reinforcing bar binding machine
2 . . . housing
3 . . . wire reel containing portion
4 . . . wire guide nose
5 . . . hook cover
6 . . . reel support boss
7 . . . reflection type photosensor
8 . . . rotation detecting lever
8*a* . . . arm portion
9 . . . magnet
10 . . . board
11 . . . Hall element
12 . . . wire guide hole
13 . . . reel cover
21 . . . wire reel
22 . . . hub
23 . . . reel flange
24 . . . reel flange
25 . . . projected portion.
26 . . . reflection mark

BEST MODE FOR CARRYING OUT THE INVENTION

One or more embodiments of the invention will be explained in reference to the drawings as follows.

Embodiment 1

FIG. 1 shows a right side face of a reinforcing bar binding machine 1. The reinforcing bar binding machine 1 is provided with a binding wire feeding mechanism, a binding wire cutting mechanism, and a binding wire twisting mechanism. A wire reel is charged to a wire reel containing portion 3 formed at a rear portion of a right side face of a housing 2. A front side of the wire reel containing portion 3 is arranged with the binding wire feeding mechanism (not illustrated) including a pair of gear type pulleys brought in mesh with each other. A wire wound around the wire reel is fed to a front side by the binding wire feeding mechanism, and fed in a loop-like shape, along a wire guide nose 4 which is bent at a front portion, to be wound around a reinforcing bar. After feeding the wire by a predetermined length to be wound around the reinforcing bar by a plurality of times, the binding wire feeding mechanism is stopped, a hook (not illustrated) disposed on an inner side of a hook cover 5 arranged at a front end of the binding wire twisting mechanism grabs the wire loop, the binding wire cutting mechanism (not illustrated) arranged at a vicinity of a base portion of the wire guide nose 4 cuts a rear end of the wire loop to cut to separate the wire loop from a succeeding wire. Successively, the reinforcing bar is bound by twisting one portion of the wire loop by driving to rotate the hook.

Figure 2:
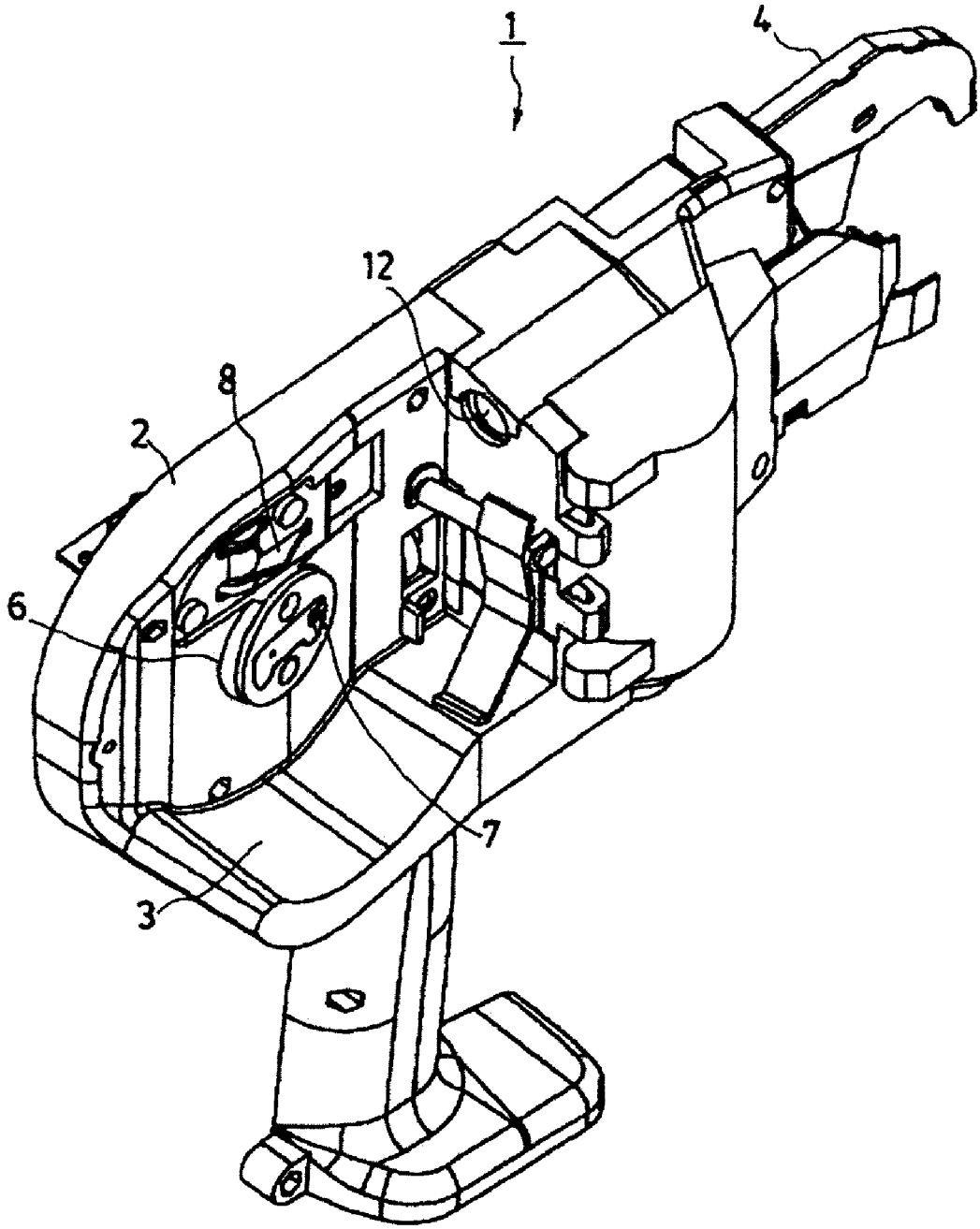
FIG. 2 is a perspective view of the reinforcing bar binding machine.

As shown by FIG. 1 and FIG. 2 (showing a right side half of the housing 2 of a two left and right split constitution), a center of the wire reel containing portion 3 is provided with a reel support boss 6 in a circular shape, a surface of the reel support boss 6 is arranged with a reflection type photosensor 7 integrated with a light emitting portion and a light receiving portion, and a reflection mark of the wire reel, mentioned later, is detected by the reflection type photosensor 7. Further, a ridge shape projected portion of a rotation detecting lever 8 (movable member 8) of the reel rotation detecting mechanism is projected into the wire reel containing portion from a slit formed on an upper side of the reel support boss 6.

Figure 3:
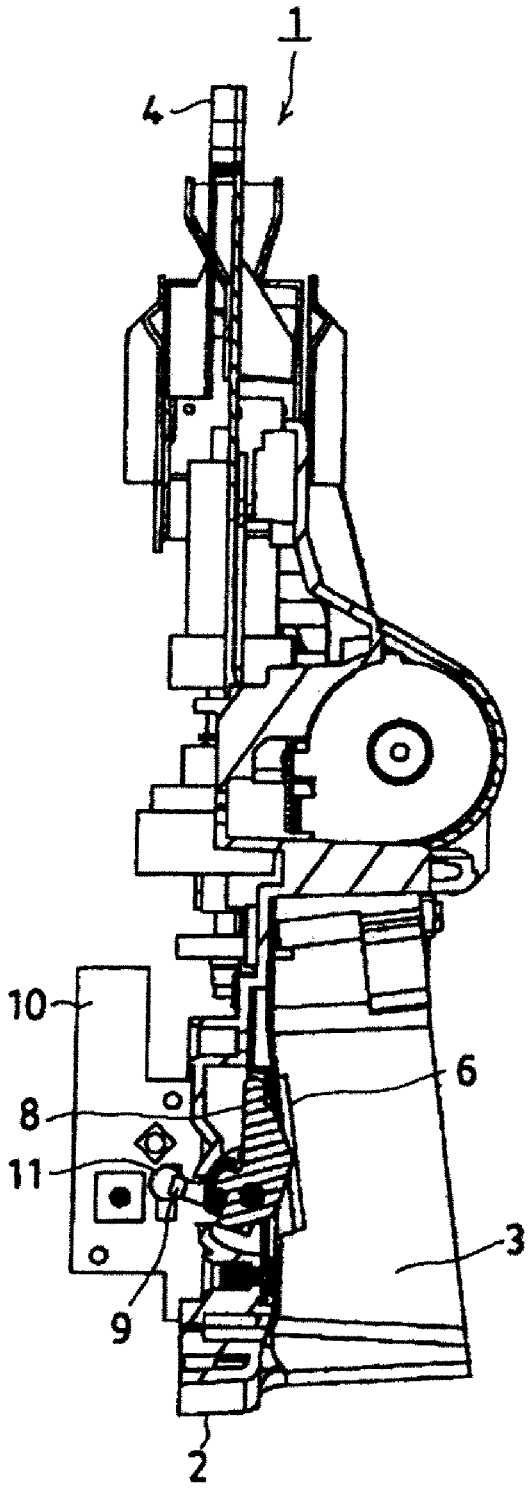
FIG. 3 is a plane sectional view of the reinforcing bar binding machine.
Figure 4:
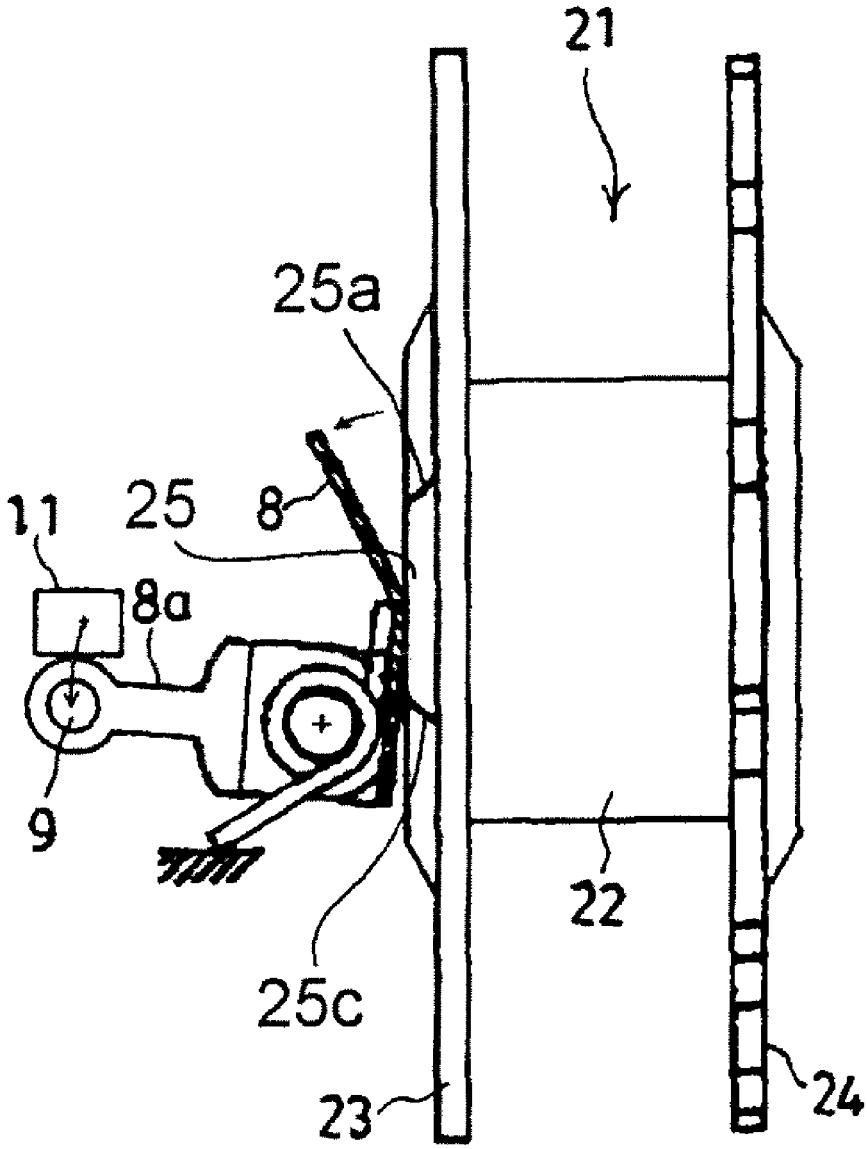
FIG. 4 is a planer explanatory view of a reel rotation detecting mechanism of the reinforcing bar binding machine.

As shown by FIG. 3, an arm portion 8*a* connected to the rotation detecting lever 8 is attached with a magnet 9, in an initial state, the magnet 9 is disposed right above a Hall element 11 mounted on a board 10, as shown by FIG. 4, in rotating the wire reel, when the rotation detecting lever 8 is brought into contact with a projected portion 25 of the wire reel 21 to be pressed to the depth side, the magnet 9 is separated from the Hall element 11, and a voltage signal in accordance with a change in a magnetic force by moving the rotation detecting lever 8 is outputted from the Hall element 11 (switch 11) to a control portion (not illustrated). That is, according to the embodiment, a wire identification information detecting mechanism includes the movable member 8, the switch 11 switched ON/OFF by the movable member 8, and the photosensor 7.

Figure 5:
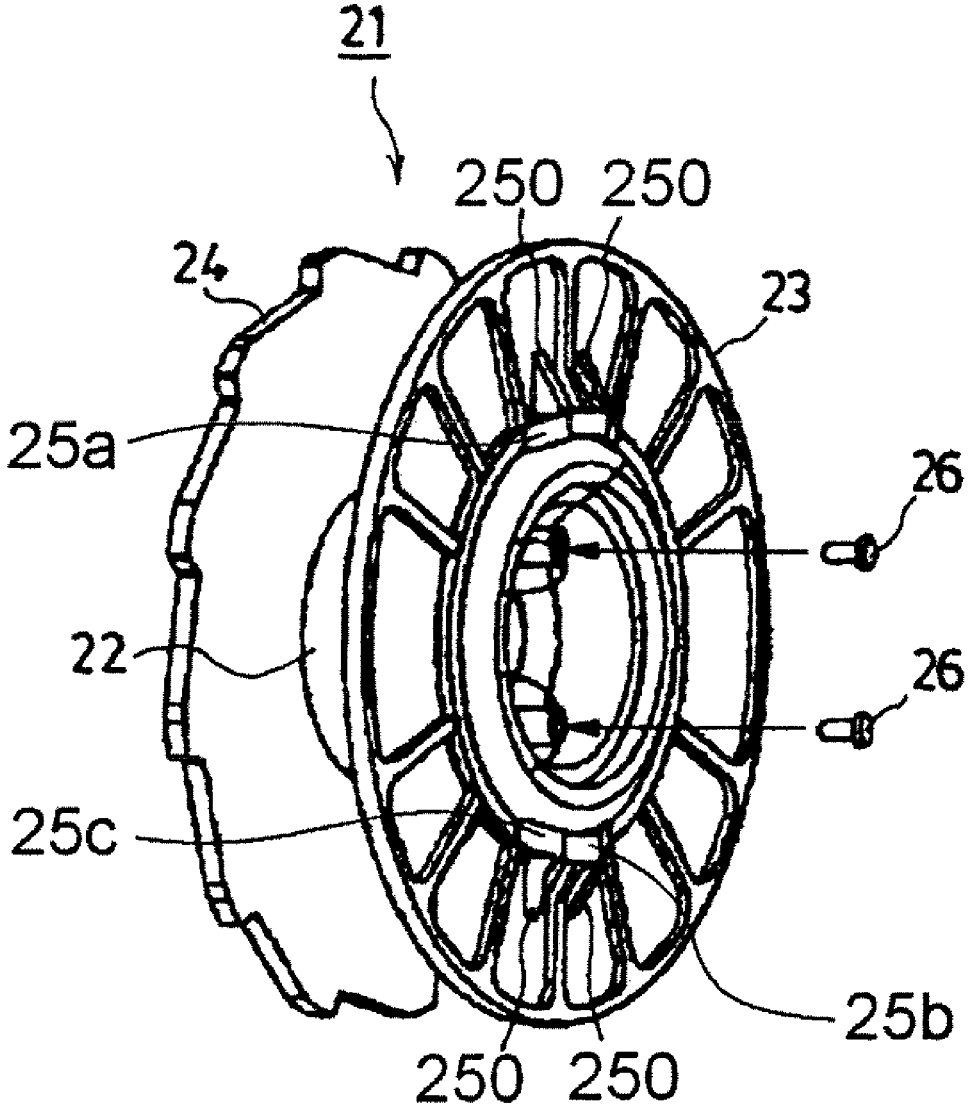
FIG. 5 is a perspective view of a wire reel.
Figure 6:
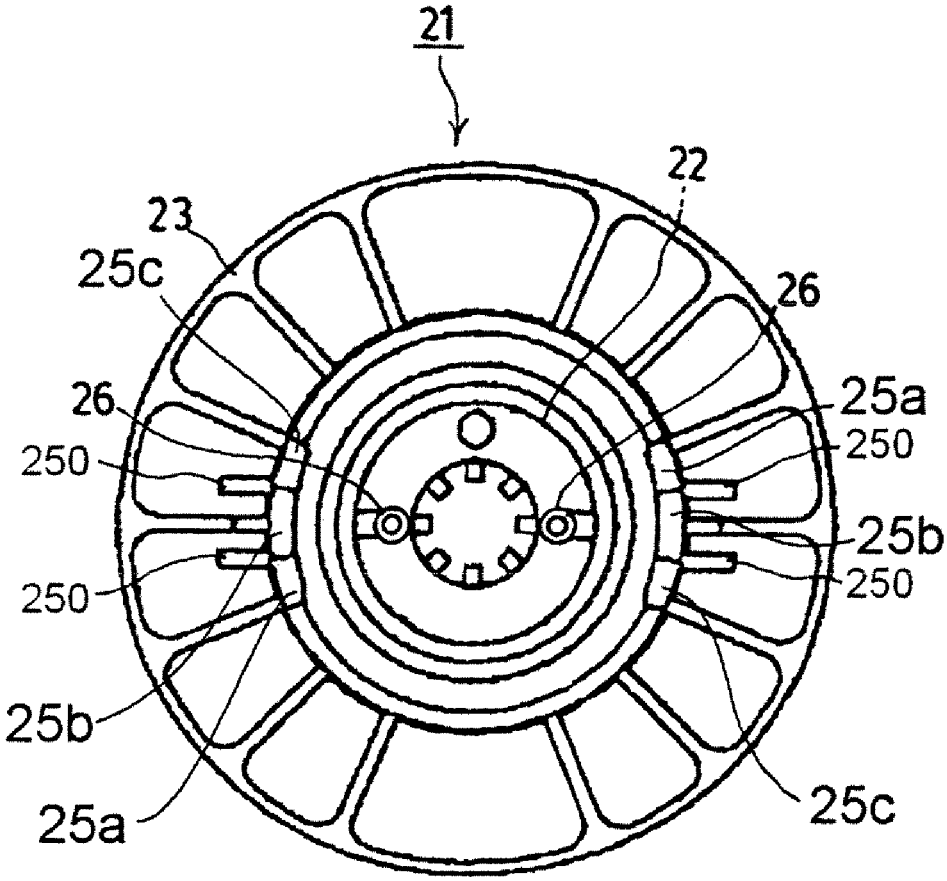
FIG. 6 is a front view of the wire reel.
Figure 6A:
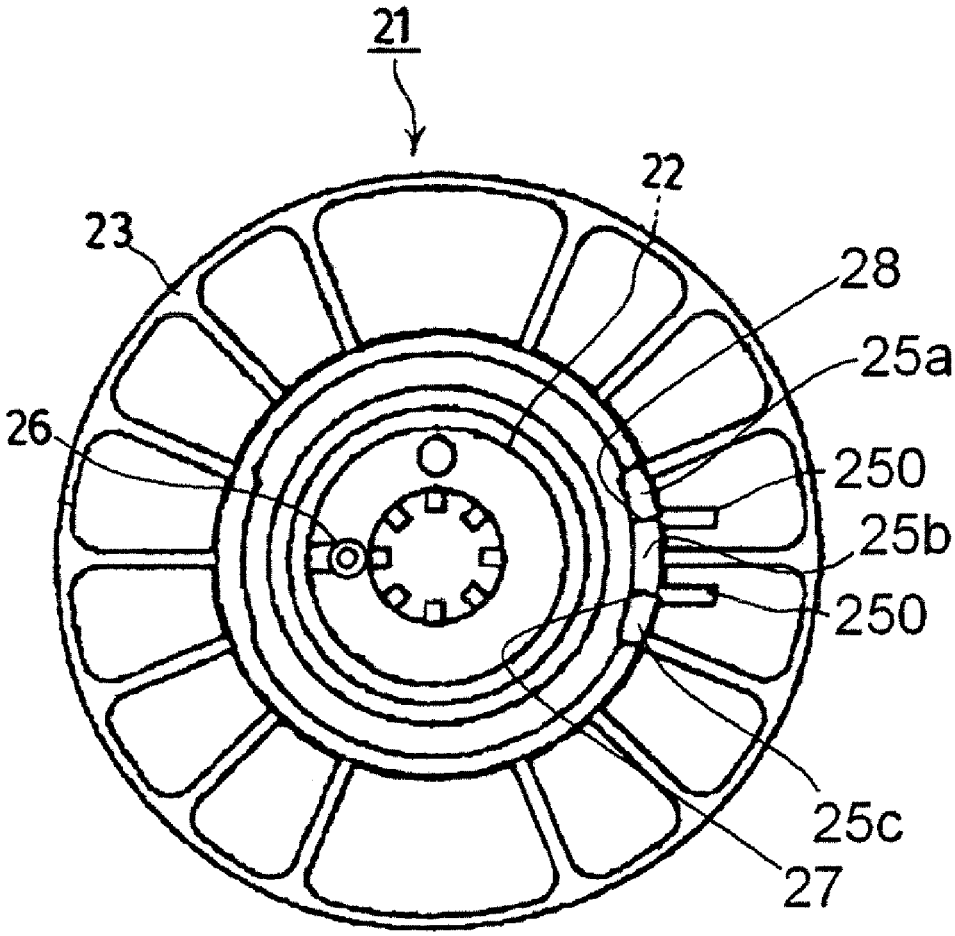

FIG. 5 and FIG. 6 show a wire reel 21 which is a resin molded product integrally molded with reel flanges 23, 24 at both side faces of a hub 22 in a cylindrical shape, a face on an outer side of the reel flange 23 on one side is provided with the projected portion 25 in correspondence with the rotation detecting lever 8 mentioned above, and a reflection mark 26 in correspondence with the reflection type photosensor 7. The projected portion 25 is constituted by a rib in which a shape of a side face thereof extended radially from a position of an outer periphery of the hub 22 is a triangular shape. The reflection mark 26 is a pin made of resin of white color and is press-fitted into a pin hole provided at the side face of the hub 22. An optical reflectance of the reflection mark 26 of white color significantly differs from that of the wire reel 21 of black color or dark color, and when the wire reel 21 is rotated and the reflection mark 26 passes a front face of the reflection type photosensor 7, an output of the reflection type photosensor 7 is changed to ON.

Two sets of the projected portions 25 are arranged at 180 degrees rotational symmetrical positions and the projected portion 25 is detected at each half rotation of the wire reel 21. Further, although in the illustrated example, ones of the reflection mark 26 are arranged at 180 degrees rotational symmetrical positions and a single one of the reflection mark 26 is detected at each half rotation of the wire reel 21, by using several kinds of wire reels having different numbers of the reflection marks 26, the kind of the wire reel can be determined from the number of the reflection marks 26, thereby, the kind of the wire wound around the wire reel can be recognized.

Figure 7:
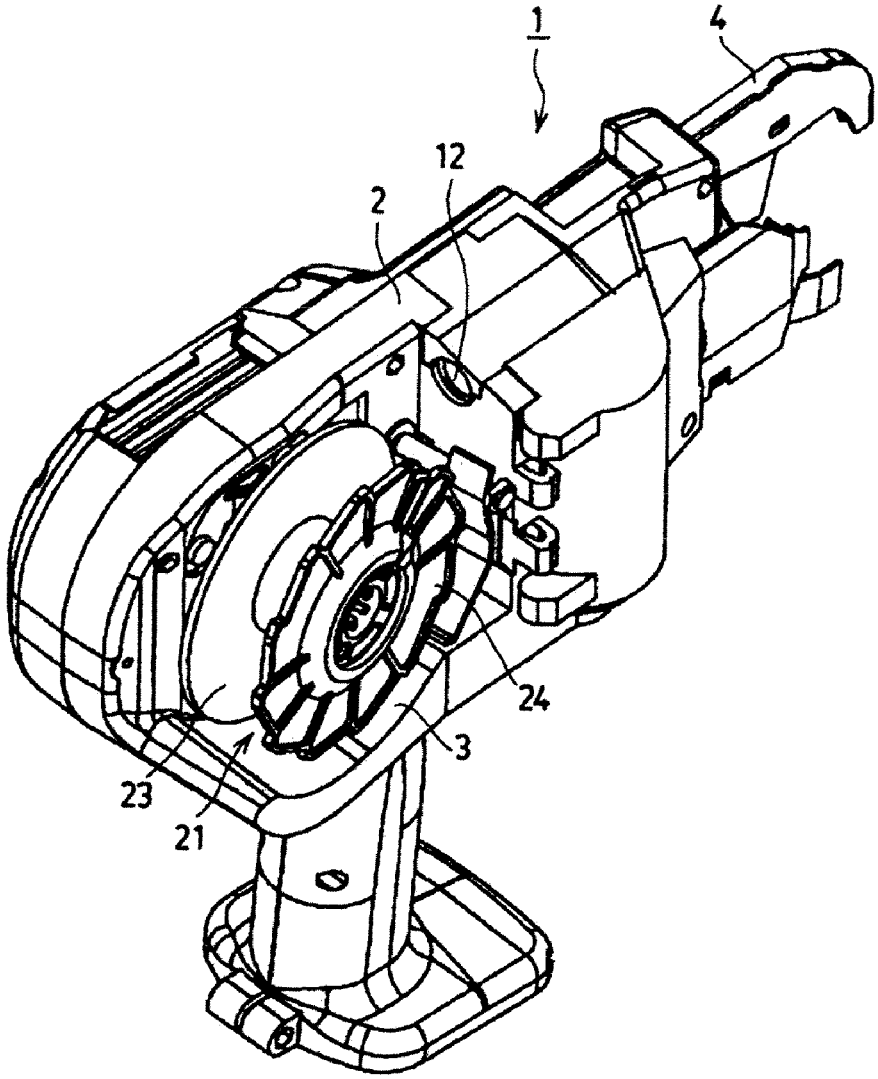
FIG. 7 is a perspective view of a reinforcing bar binding machine.
Figure 8:
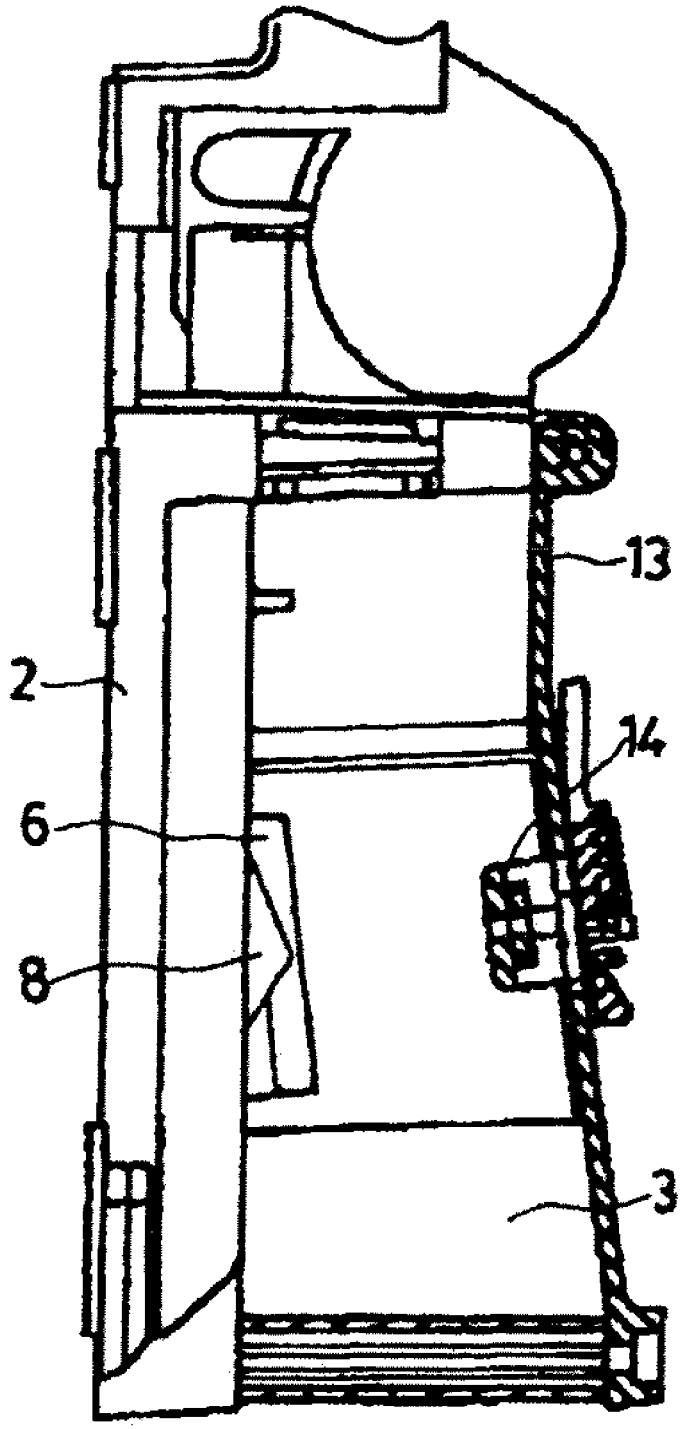
FIG. 8 is a plane sectional view of the reinforcing bar binding machine.

FIG. 7 shows a state of charging the wire reel 21 to the wire reel containing portion 3 of the reinforcing bar binding machine 1, here, showing a state of removing a reel cover attached to the housing 2. The wire reel 21 is charged in a direction in which the reel flange 23 provided with the projected portion 25 and the reflection mark 26 of the wire reel 21 is opposed to a wall face of the wire reel containing portion 3, the front end of the wire is inserted into a wire guide hole 12 on the front side, the wire is passed between a pair of gear type pulleys of the binding wire feeding mechanism on the front side and a reel cover 13 shown in FIG. 8 is closed. As shown by the drawing, when the reel cover 13 is closed, a reel support boss 14 formed on an inner face side of the reel cover 13 is fitted to a center hole of a hub of a wire reel (not illustrated) and the wire reel is supported by the reel support boss 6 of the wire reel containing portion 3 and the reel support boss 14 of the reel cover 13. As described above, when the rotation detecting lever 8 at inside of the wire reel containing portion 3 is brought into contact with the projected portion 25 of the reel flange 23 in accordance with rotation of the wire reel 21, the rotation detecting lever 8 is pressed in the depth direction by the projected portion 25 and outputs a projected portion detecting signal. Further, an output signal of the reflection type photosensor 7 is inverted when the reflection mark 26 passes a front face thereof and the control portion detects the reflection mark 26 and the kind of wire is determined by the number of pieces of the reflection marks 26.

A characteristic of the invention resides in that the above-described determination of the kind of the wire is carried out not in an initializing operation in charging the wire reel but in a reinforcing bar binding operation. An advantage of determining the kind of the wire not in rotating the wire reel at the low speed in the initializing operation but in the binding operation resides in that in the binding operation, the wire is fed at high speed, the wire reel is rotated at high speed and therefore, the speed of the projected portion 25 of the wire reel 21 of impinging on the rotation detecting lever 8 is fast, thereby, also the rotation detecting lever 8 is pivoted at high speed to be firmly moved to the detecting position, since rotational inertia is larger than that in rotating at low speed, lateral fluctuation or swinging of the wire reel is reduced and ambiguousness of a range of pivoting the rotation detecting lever 8 is reduced.

Figure 9:
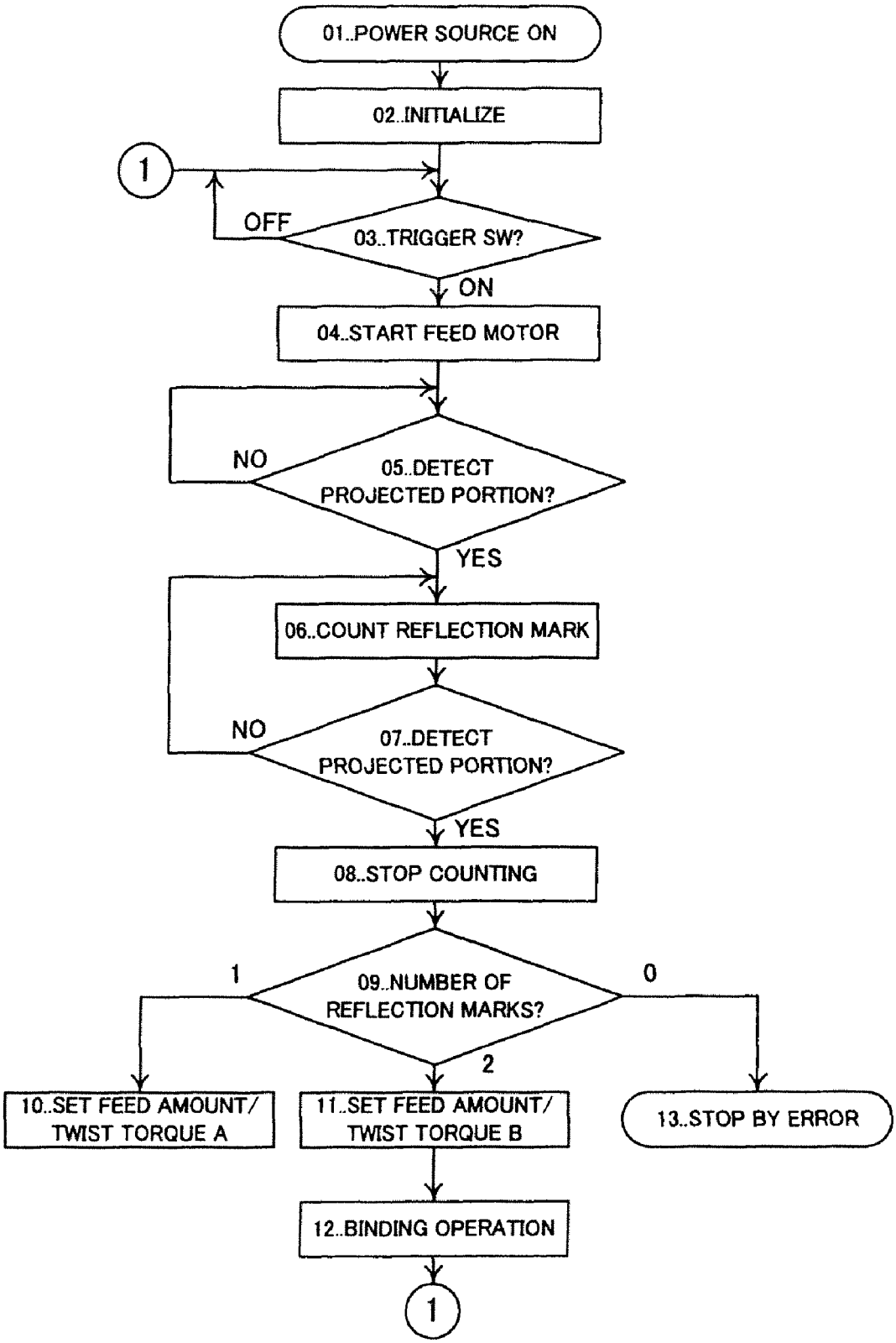
FIG. 9 is a flowchart of operation of determining a wire of the reinforcing bar binding machine.
Figure 10:
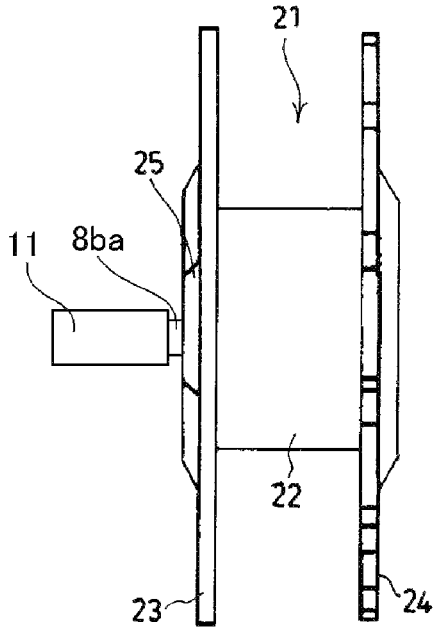
FIG. 10 is a plane explanatory view of another embodiment of the reel rotation detecting mechanism including a button actuator.

Operation of the reinforcing bar binding machine 1 will be explained in accordance with a flowchart of FIG. 9. When the wire reel 21 is charged to the reinforcing bar binding machine 1 and a power source switch is switched ON (step 01), similar to a machine of the background art, the wire is fed by a predetermined length by driving the binding wire feeding mechanism at low speed, and initialization of setting the binding wire twisting mechanism to an initial position is executed to bring about a standby state (step 02).

When a the trigger lever is operated to be ON in the standby state, binding operation is started (step 03), the binding wire feeding mechanism feeds the wire at a speed of the binding operation (step 04), thereby, the wire reel is rotated at high speed.

When the wire reel 21 is rotated, the projected portion 25 of the reel flange portion 23 impinges on the rotation detecting lever 8 and the rotation detecting lever 8 is pressed, a detecting signal is inputted from the Hall element 11 to the control portion (step 05), and the control portion starts counting the reflection mark 26 (step 06).

By rotating the wire reel 21, the reflection mark 26 is detected by the reflection type photosensor 7, the control portion sums up the number of detection, and when the projected portion 25 of the wire reel 21 is detected again by the rotation detecting lever 8 (step 07), counting of the reflection mark 26 is stopped (step 08).

According to the wire reel 21 shown in FIG. 5 and FIG. 6, the projected portions 25 are arranged at an interval of 180 degrees and therefore, a reflection mark detecting cycle of one time (steps 05 through 08) is a half rotation of the wire reel 21, also the reflection marks 26 are arranged piece by piece at the interval of 180 degrees and therefore, in this example, a number of detecting the reflection mark in the reflection detecting cycle of one time becomes 1. Further, when two pieces of the reflection marks 26 arranged at interval of 180 degrees, the number of detecting the reflection mark in the reflection mark detecting cycle of one time becomes 2.

For example, by constituting A type by the wire reel arranged with one pieces of the reflection marks at interval of 180 degrees, constituting B type by the wire reel arranged with two pieces of the reflection marks at interval of 180 degrees and mounting wires respectively having different wire diameters thereto, from the type of the wire reel, the kind of the wire wound therearound can be determined (step 09).

By programming the control portion such that individual wire feeding amounts and twist torque values are previously set to the A type wire reel and the B type wire reel and the wire feeding amount and the twist torque value are set in accordance with the kind of the wire determined, a pertinent wire feeding amount and a pertinent twist torque value are selected to be set in accordance with the kind of the wire (step 10 or step 11).

Further, a series of binding operation comprising wire feeding, twisting and cutting is executed by the set wire feeding amount and the twist torque value A or B (step 12), and the operation returns to the state of awaiting for the operation for making the trigger lever ON (step 03).

Further, when a number of counts from starting to count the reflection mark at step 06 to stop counting at step 08 is zero, that is, the reflection mark cannot be detected at the reflection mark detecting cycle of one time, it is determined that rotation of the wire reel is failed, or the wire reel is a wire reel which is not suitable for the reinforcing bar binding machine 1, the operation proceeds from step 09 to step 13 to stop operation.

Figure 11:
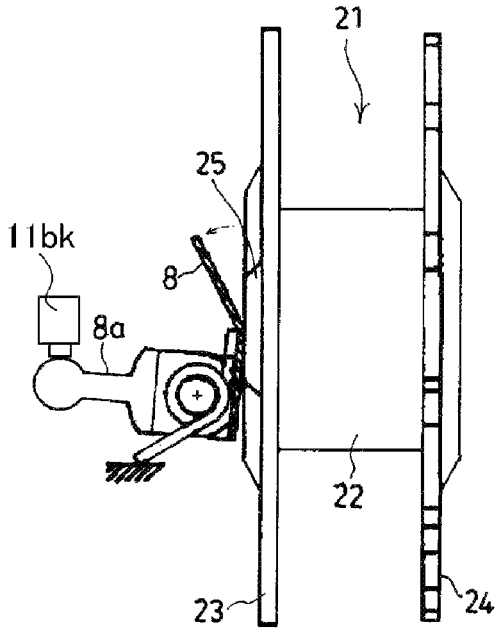
FIG. 11 is a plane explanatory view of another embodiment of the reel rotation detecting mechanism including a breaker.

Further, the movable member 8 may be constituted by a button actuator 8*ba* as shown in FIG. 11. The switch 11 may be constituted by a breaker 11*bk* as shown in FIG. 11. In place of the reflection mark 26, a bar code may be used. In place of the projected portion 25, a recess portion may be formed.

Further, the invention is not limited to the above-described embodiments but can variously be modified within the technical range of the invention and it is apparent that the invention covers the modified constitutions.

The application is based on Japanese Patent Application (Japanese patent Application No. 2004-139069) filed on May 7, 2004 and contents of which are hereby incorporated by reference.

INDUSTRIAL APPLICABILITY

There is provided means for detecting the wire identifying information of the projected portion or the recess portion, or the reflection mark provided at the side face of the reel flange of the wire reel. As the wire identification information detecting means, a constitution combined with the lever and the switch or the photosensor or the like is applicable. The wire identification information is detected from the wire reel rotated in the binding wire feeding step in starting the binding operation.

According to one or more the embodiments of the invention, the wire identifying information provided at the side face of the reel flange of the wire reel is detected in the binding wire feeding step in starting the binding operation and therefore, in comparison with the constitution of the background art of reading the wire identifying formation in the initializing operation of feeding the wire at low speed when the power source is switched ON, the wire identifying information is detected in a state of rotating the wire reel at faster speed, particularly, in a mechanical constitution of detecting the projected portion or the recess portion provided at the wire reel by the lever or the like, a width of moving the movable member of a lever or the like is widened and certainty is promoted.

The invention claimed is:

1. A reinforcing bar binding machine comprising:

a wire identification information detecting mechanism that detects wire identifying information provided at a side face of a reel flange of a wire reel during a rotation of the wire reel, wherein the reinforcing bar binding machine controls a torque of twisting or an amount of feeding a wire based on the detected wire identifying information;

wherein the wire identification information detecting mechanism includes:

a movable member opposed to the side face of the reel flange of the wire reel;

a first detector configured to be switched ON/OFF by the movable member; and a second detector opposed to the side face of the reel flange of the wire reel.

2. The reinforcing bar binding machine according to claim 1, further comprising:

a binding wire feeding mechanism;

a binding wire twisting mechanism; and a binding wire cutting mechanism.

3. The reinforcing bar binding machine according to claim 1, wherein the first detector comprises a switch switched ON/OFF by the movable member.

4. The reinforcing bar binding machine according to claim 3, wherein the movable member includes a lever.

5. The reinforcing bar binding machine according to claim 3, wherein the movable member includes a button actuator.

6. The reinforcing bar binding machine according to claim 3, wherein the switch includes a breaker.

7. The reinforcing bar binding machine according to claim 3, wherein the switch includes a Hall element.

8. The reinforcing bar binding machine according to claim 7, wherein the movable member includes a magnet, and the Hall element is switched ON/OFF by the magnet.

9. The reinforcing bar binding machine according to claim 3, wherein the switch is adapted to detect the wire identifying information, when the wire reel is rotated in a binding wire feeding step in a binding operation, by displacing the movable member by a projected portion or a recess portion indicating the wire identifying information formed at the side face of the reel flange.

10. The reinforcing bar binding machine according to claim 1, wherein the second detector comprises a photosensor opposed to the side face of the reel flange of the wire reel.

11. The reinforcing bar binding machine according to claim 10, the photosensor is adapted to the wire identifying information formed at the side face of the reel flange, when the wire reel is rotated in a binding wire feeding step in a binding operation.

12. The reinforcing bar binding machine according to claim 11, wherein the wire identifying information includes a reflection mark.

13. The reinforcing bar binding machine according to claim 11, wherein the wire identifying information includes a bar code.

14. The reinforcing bar binding machine according to claim 1, wherein the first detector comprises a switch switched ON/OFF by the movable member; and wherein the second detector comprises a photosensor opposed to the side face of the reel flange of the wire reel.

* * * * *